US008874011B2

(12) United States Patent
Ishikuro et al.

(10) Patent No.: US 8,874,011 B2
(45) Date of Patent: Oct. 28, 2014

(54) DEVELOPER CONTAINER AND PACKAGING SYSTEM

(75) Inventors: Takemasa Ishikuro, Tokyo (JP); Tatsuya Murakami, Tokyo (JP); Takuya Goto, Tokyo (JP); Teruo Soeda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 229 days.

(21) Appl. No.: 13/480,558

(22) Filed: May 25, 2012

(65) Prior Publication Data

US 2012/0301187 A1 Nov. 29, 2012

(30) Foreign Application Priority Data

May 26, 2011 (JP) ..... 2011-118226

(51) Int. Cl.
*G03G 15/08* (2006.01)
*G03G 15/04* (2006.01)

(52) U.S. Cl.
CPC .... *G03G 15/0832* (2013.01); *G03G 2215/0872* (2013.01); *G03G 2215/0886* (2013.01)
USPC ..... 399/262; 399/119

(58) Field of Classification Search
CPC ..... G03G 2215/0872; G03G 2215/0886; G03G 21/1676
USPC ..... 399/119, 262
See application file for complete search history.

(56) References Cited

U.S. PATENT DOCUMENTS

| | | | | |
|---|---|---|---|---|
| 5,943,528 | A * | 8/1999 | Akutsu et al. | 399/110 |
| 2009/0074472 | A1 * | 3/2009 | Kwon | 399/262 |
| 2009/0190963 | A1 * | 7/2009 | Nozawa | 399/262 |

FOREIGN PATENT DOCUMENTS

| | | | |
|---|---|---|---|
| JP | 02-121752 | U | 10/1990 |
| JP | 2007-256352 | A | 10/2007 |
| JP | A-2009-134032 | | 6/2009 |
| JP | 2009-175403 | A | 8/2009 |

* cited by examiner

*Primary Examiner* — Sandra Brase
(74) *Attorney, Agent, or Firm* — Muncy, Geissler, Olds & Lowe, P.C.

(57) ABSTRACT

A developer container includes a developer containing member that contains developer; an opening part through which the developer is externally supplied, and a pressure absorbing mechanism that is provided on an external portion of the developer containing member. The pressure absorbing mechanism is configured to deform in an inward direction toward the developer container when an external force is applied to the developer container.

24 Claims, 11 Drawing Sheets

DEVELOPER CONTAINER AND PACKAGING SYSTEM

CROSS REFERENCE TO RELATED APPLICATION

The present application is related to, claims priority from and incorporates by reference Japanese Patent Application No. 2011-118226, filed on May 26, 2011.

TECHNICAL FIELD

The present application relates to an image forming unit, an image forming unit housing, an image forming device and a developer container.

BACKGROUND

Image forming devices, such as printers, photocopy machines, facsimile devices, multifunction peripherals having a printer part and a scanner part, and the like, include an image forming unit that forms a developer image on a print medium, such as sheet and the like, using a developer, such as toner. To the image forming unit, toner cartridges are provided as developer containers.

In addition, a toner cartridge is known that is configured removably with respect to the image forming unit (see, for example, JP Laid-Open Patent Application No. 2009-134032). As such a cartridge, there are a toner cartridge that is pre-equipped to the image forming device and a toner cartridge having various toner capacity to which a large or small amount of toner can be added depending on the user's printing frequency. These contribute in increasing the user's convenience.

An outer cartridge that configures an external member of the toner cartridge is generally a resin product from a view point of being light weight and securing freedom of a shape as a product. Therefore, the outer cartridge is mainly formed by a resin that has a good flowability, such as polystyrene, for forming in a cylindrical shape. Especially, in order to make it with a small weight, it is preferable to thin the wall as much as possible.

To prevent the toner leakage, the toner cartridge is highly airtight. Therefore, the toner cartridge is seldom provided with a hole for ventilating air, in addition to the toner ejection opening.

At the time of replacing the toner cartridge, it is necessary to hold the outside surfaces of the outer cartridge that accommodates toner inside the space therein.

However, because the outer cartridge is formed by a thick resin material in the cylindrical shape so as to maintain the shape, a pressure applies to the inside of the outer cartridge as the outer cartridge warps, when the user firmly hold the outer surface of the outer cartridge at the time of replacing the toner cartridge. As a result, there is a problem that air inside flows from an opening part of the toner cartridge, which is an opening for supplying toner to the development part, causing the toner remaining inside the toner cartridge or the toner attached to the periphery of the opening part to be scattered and leaked from the toner cartridge.

The present considers the above-described problem. An object of the present application is to prevent the developer from being scattered and leaked from the toner cartridge when the developer container is held.

SUMMARY

A developer container includes a developer containing member that contains developer; an opening part through which the developer is externally supplied, and a pressure absorbing mechanism that is provided on an external portion of the developer containing member. The pressure absorbing mechanism is configured to deform in an inward direction toward the developer container when an external force is applied to the developer container.

In another aspect of the invention, a packaging system includes a package box, and the developer container above. An upper surface of the pressure absorbing mechanism which covers the upper surface of the developer container is substantially flat, when the developer container is housed in the package box, the upper surface of the pressure absorbing mechanism fits against an inner surface of the package box so that there is not space between the box and the developer container along the flat upper surface of the pressure absorbing mechanism.

According to the present application, the developer is prevented from being scattered and leaked from the toner cartridge when the developer container is being held.

BRIEF DESCRIPTION OF THE DRAWINGS

FIG. 2A is a perspective view seeing from a front oblique upper position, and FIG. 2B is a perspective view seeing from a rear oblique upper position.

FIG. 4A illustrates a state where an opening part is closed, and FIG. 4B illustrates a state where the opening part is open.

FIG. 5A illustrates a state where the toner cartridge is held. FIG. 5B illustrates a state where a lever is rotated to close the opening part. FIG. 5C illustrates a state where the toner cartridge is held and removed by pulling the toner cartridge upwardly.

FIG. 8A is a schematic diagram viewed from the front side. FIG. 8B is a schematic cross-sectional view seen from the line D-D shown in FIG. 8A.

FIG. 10A is a schematic diagram viewed from the front side. FIG. 10B is a schematic cross-sectional view seen from the line L-L shown in FIG. 10A.

DETAILED DESCRIPTION OF EMBODIMENTS

Embodiments of the present application are explained below with reference to the attached drawings. One of the primary components of the invention is a pressure absorbing mechanism. With the mechanism, an external force (or pressure), which is applied to a developer container e.g. a toner cartridge, is absorbed or decreases. Thereby, the deformation amount of a wall of the developer containing member, which is deformed inwardly, can be reduced as much as possible. Accordingly, developer which is contained in the container is prevented from leaking from the container.

For embodiments of the pressure absorbing mechanism, two types of the mechanism are disclosed in the application. In the first type, the pressure is absorbed using soft material which is easily deformed. More specifically, soft material parts 126*a* and 126*b* for the first embodiment and soft material part 126*c* for the second embodiment are disclosed. These soft material parts are formed with a deformable material in order to be deformed according to an external force. In the second type, an extra wall (outer wall) is provided in the surroundings of the developer containing member so that a dual wall part is configured. Due to a space between the extra wall and the developer containing member, it is realized that an inward deformation of the extra wall does not invade the developer containing member. More specifically, dual wall part 134 for the third embodiment and dual wall part 134*a* are disclosed. In these embodiments, the dual walls are formed with holding parts 141, 142, 132*a* and a wall of developer containing member 131, 131*a*.

In this invention, there is not limit where to dispose the pressure absorbing mechanism. The pressure absorbing mechanism is provided on any external portion of the developer containing member.

First Embodiment

Figure 1:
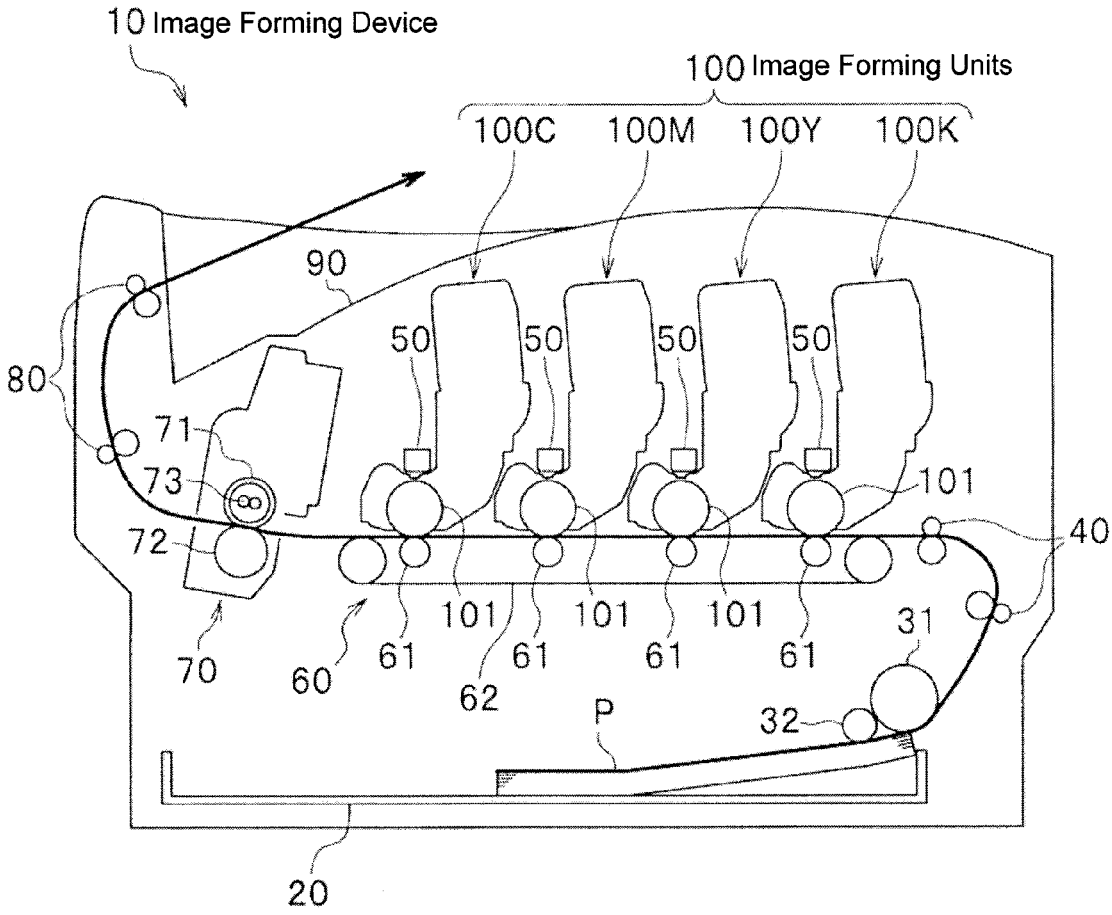
FIG. 1 is a diagram illustrating a schematic configuration of an image forming device according to a first embodiment.

FIG. 1 is a diagram illustrating a schematic configuration of an image forming device according to a first embodiment. Here, a printer is used as an image forming device. In addition, the left side of FIG. 1 is called "front," and the right side is called "rear."

As shown in FIG. 1, the image forming device 10 includes a sheet supply cassette 20, a sheet supply roller 31, a sheet supply subroller 32, a registration part 40, an image forming unit 100, a light emitting diode (LED) head 50, a transfer unit 60, a fusion unit 70, an ejection roller part 80, and a medium stacking part 90.

The sheet supply cassette 20 accommodates print media (hereinafter, simply referred to as "medium" or "media") P, such as sheets of paper. The sheet supply roller 31 and the sheet supply subroller 32 separate each medium P accommodated in the sheet supply cassette 20 and carry to the registration part 40. The registration part 40 is a registration roller, for example. The registration part 40 aligns the front end of the medium carried and carries the medium to the transfer unit 60.

The image forming unit 100 forms a developer image (hereinafter, referred to as "toner image") using the toner as the developer, on the medium P and is a collective term of image forming units 100C, 100M, 100Y and 100K that form toner images in the respective colors of cyan, magenta, yellow and black on the medium P. The image forming unit 100 includes a photosensitive body 101 (e.g., photosensitive drum) as an image carrier and transfers the toner image obtained by visualizing (developing) an electrostatic latent image formed on the photosensitive drum 101 onto the medium P.

The LED head 50 forms the electrostatic latent image on the photosensitive drum 101 by irradiating recording light in response to print information.

The transfer unit 60 includes a transfer roller 61 that transfers the toner image formed on the photosensitive drum 101 onto the medium P by applying a transfer voltage at a position facing the photosensitive drum 101, and a carrying belt 62 that carries the medium P towards the fusion unit 70.

The fusion unit 70 includes a fusion roller 71, a pressure application roller 72 and a heater 73. The heater 73 is a halogen lamp, for example, and heats up the fusion roller 71. The fusion roller 71 melts the unfixed toner on the medium P on a surface of the fusion roller 71 heated by the heater 73. The pressure application roller 72 applies pressure to the fusion roller 71 by a pressure force from a spring (not shown) to fix the transferred toner image onto the medium P and carries the medium P towards the ejection roller part 80.

The ejection roller 80 ejects the medium P carried from the fusion unit 70 towards the medium stacking part 90. The medium stacking part 90 stacks, for example, a plural number of the media P ejected by the ejection roller part 80.

In the image forming device 10 configured as described above, when a print instruction is received through an operation part and/or a communication part (not shown), the medium P, which is picked up from the sheet supply cassette 20 by the sheet supply roller 31 and the sheet supply subroller 32, is carried to the registration part 40. The front end of the medium P is aligned by the registration part 40 and is carried to a nip position, at which the photosensitive drum 101 and the transfer roller 61 face and contact each other. In the meantime, toner is supplied to the photosensitive drum 101 on which the electrostatic latent image is formed by the LED head 50, and thereby a visible toner image is formed on the photosensitive drum 101. Then, to the medium P that has reached the nip position, the transfer voltage is applied by the transfer roller 61, and therefore, the toner image on the photosensitive drum 101 is transferred onto the medium P.

The medium P, which has passed the transferred roller 61 for each color and on which the toner image of each color has been transferred, is carried to the fusion unit 70, at which the toner on the medium P is melted and fixed thereon by the heat from the heater 73 provided in the fusion roller 71 and the pressure force from the pressure application roller 72. The medium P onto which the toner image is thereby fixed is carried to the ejection roller part 80 positioned in a downstream direction by the fusion roller 71 and the pressure application roller 72 driven by the fusion roller 71. The medium P is then ejected by the ejection roller part 80 towards the medium stacking part 90.

Figure 2A:
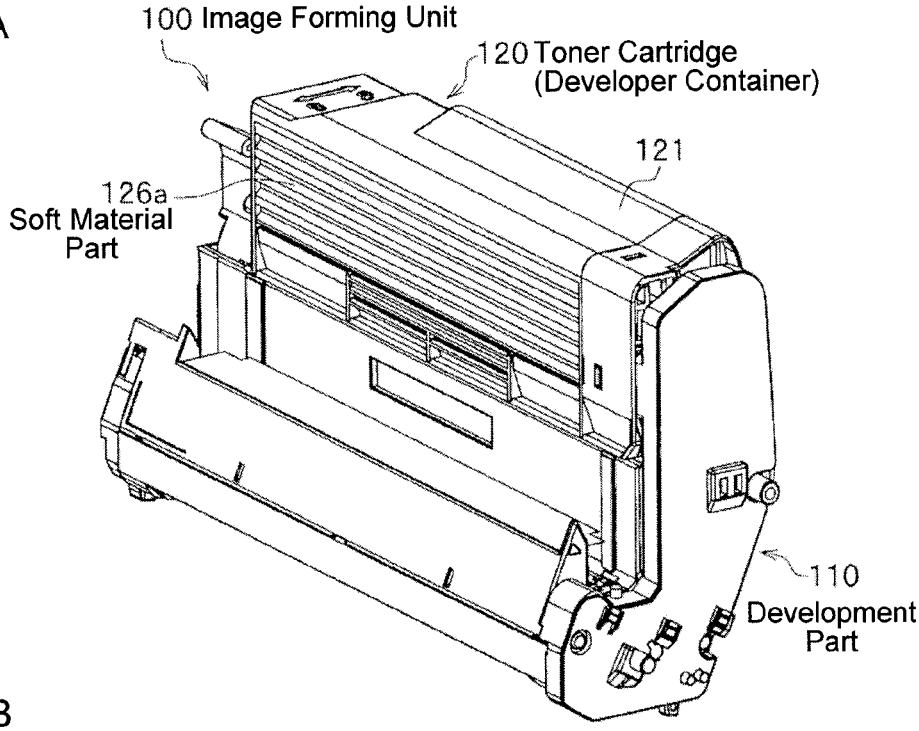
FIGS. 2A and 2B are external perspective views of an image forming unit according to the first embodiment.
Figure 2B:
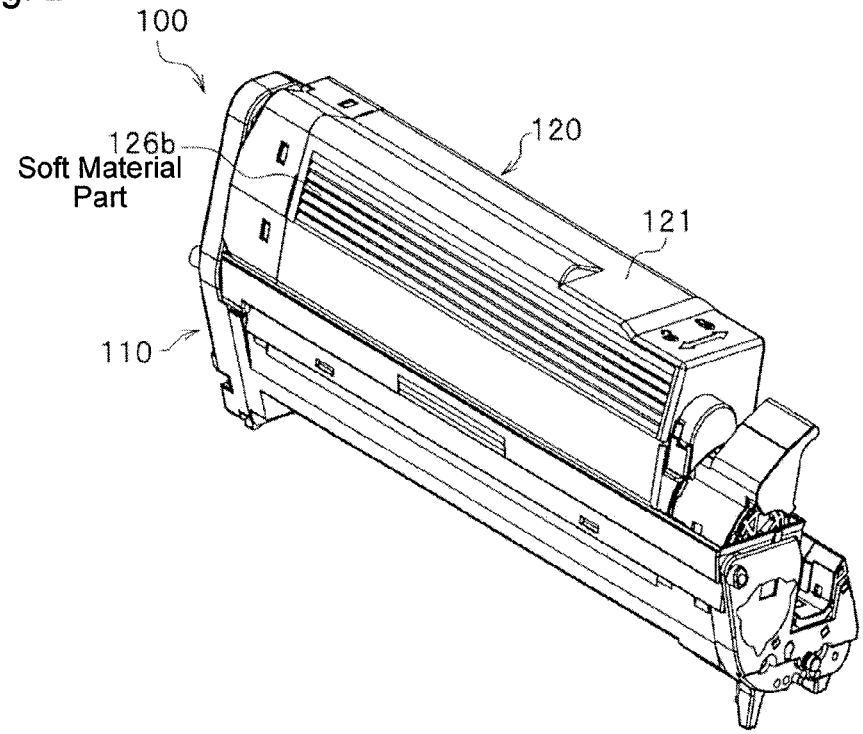
Figure 3:
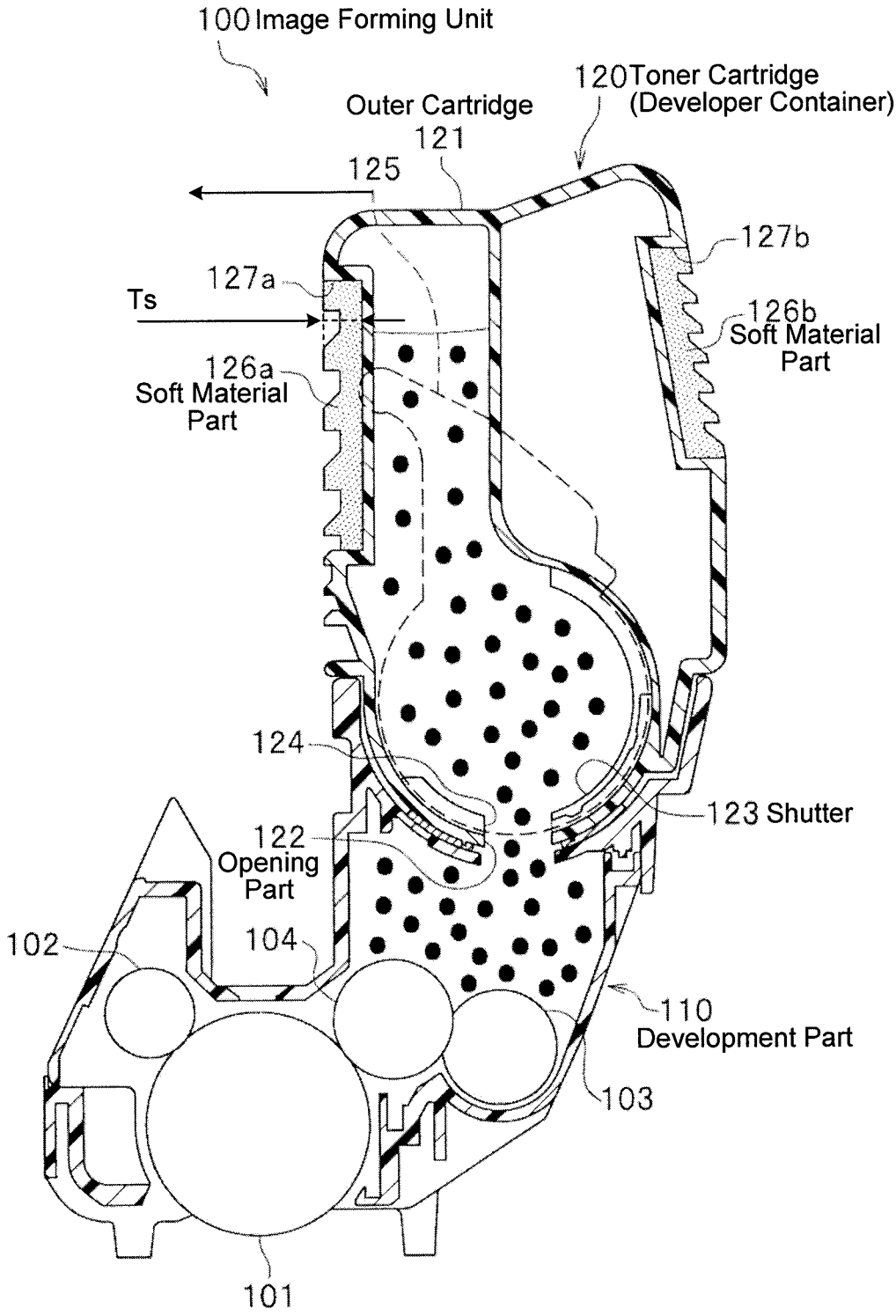
FIG. 3 is a schematic cross-sectional view of the image forming unit according to the first embodiment.

As shown in FIGS. 2A-3, the image forming unit 100 includes a development part 110 that visualize the electrostatic latent image using the toner, and a toner cartridge 120 as a developer container for containing the toner that is supplied to the development part 110. The toner cartridge 120 is provided freely removably with respect to the image forming unit 100.

As shown in FIG. 3, the development part 110 includes the photosensitive drum 101, a charging roller 102, a supply roller 103, a development roller 104, and the like. As described above, the photosensitive drum 101 is an image carrier on which the electrostatic latent image is formed. The charging roller 102 charges the photosensitive drum 101 by applying a certain charge to the photosensitive drum 101. The supply roller 103 supplies a necessary amount of toner to the development roller 104 side. The development roller 104 forms the toner image with a certain thickness by charging and statically attaching the toner onto the electrostatic latent image formed on the photosensitive drum 101. Black dots in FIG. 3 schematically show the toner (similarly in the subsequent drawings).

Figure 4A:
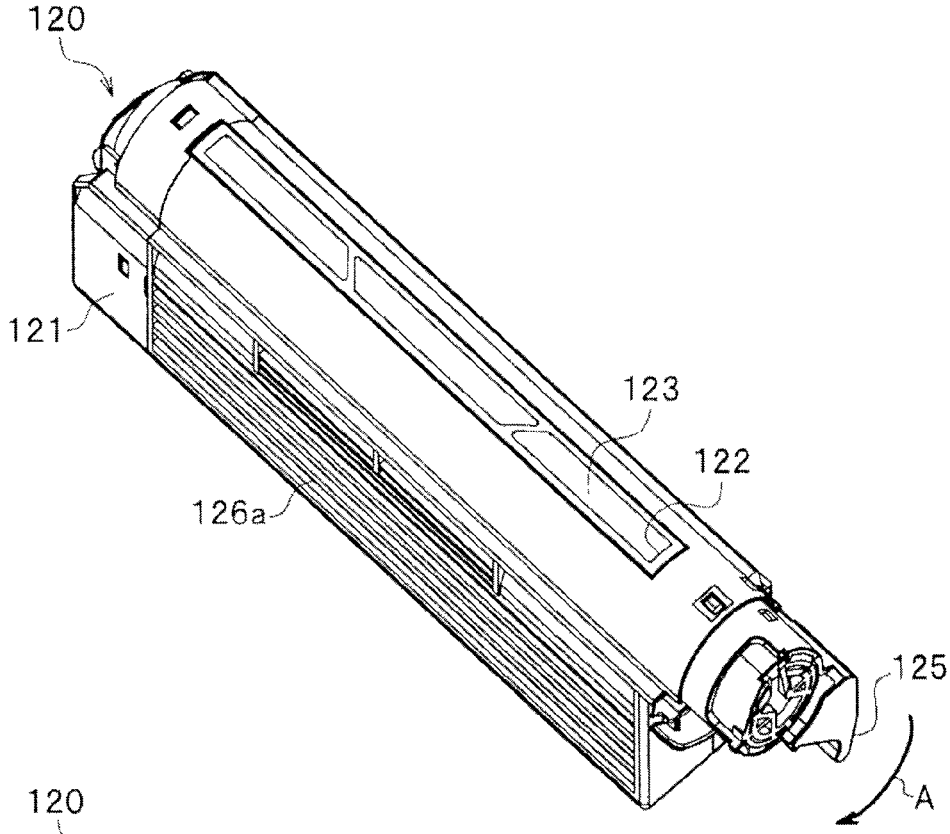
FIGS. 4A and 4B are external perspective views illustrating the toner cartridge, which is in an upside-down position from FIG. 2*b*, according to the first embodiment.
Figure 4B:
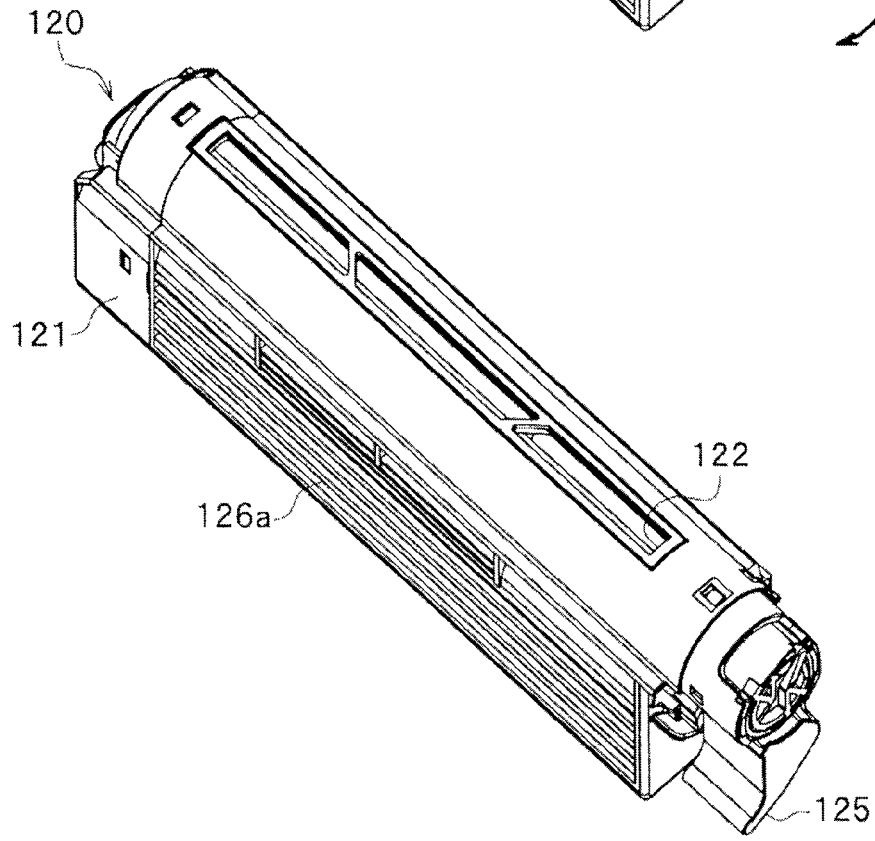

As shown in FIGS. 3-4B, the toner cartridge 120 includes an outer cartridge 121 (developer containing member) that configures an external member of the toner cartridge 120. The outer cartridge 121 is formed by a resin with good flowability, such as polystyrene and the like, in a cylindrical shape extending in a horizontal direction. The outer cartridge 121 contains the toner used for development. In view of maintaining the light weight and the minimum strength, when polystyrene is used, the thickness of the wall of the outer cartridge 121 is preferably within a range of 1 to 2 mm. The thickness of the wall of the outer cartridge is thick enough for containing the toner, however the wall is likely to be deformed inwardly when a strong external force is applied to the cartridge. The external force is caused by the operator handling, gripping, or holding the cartridge.

The outer cartridge 121 of the toner cartridge 120 includes an opening part 122 for supplying the toner to the development part 110. In addition, the toner cartridge 120 includes a shutter 123 for opening and closing the opening part 122 of the outer cartridge 121. The shutter 123 has a shape to form a part (an arc surface) of a cylindrical surface and includes an opening part 124.

The outer cartridge 121 is connected to an external part through only the opening part 122, and no other ventilatable holes are provided in addition to the opening part 122. The opening part 122 is not necessarily limited to one but may be provided a plural number of opening parts. The opening part 122 is provided at a lower part of the outer cartridge 121 in a form that allows the toner to exit from the outer cartridge 121 by own weight. The lower part here means a lower side of the outer cartridge 121 as the outer cartridge 121 is installed in the image forming device.

Assuming that the toner cartridge 121 is roughly a hexahedron, each of the surfaces are defined below. A surface which includes the opening part 122 is a lower side (bottom surface). An opposite side from the lower side is an upper side (upper surface). The remaining four sides are side surfaces. Among them, two surfaces which are disposed parallel to the rotational axis of the photosensitive body are defined first and second surface (or front and rear surfaces). The other two surfaces which are disposed perpendicular to the rotational axis are defined third and fourth surfaces. Also, it may be defined that longer surfaces are first and second, shorter surfaces are third and fourth when these are compared.

A lever 125 is connected to the shutter 123. By rotating the lever 125 in a direction of arrow A in FIG. 4A, the shutter 123 rotates about a central axis of the arc surface. As the position of the opening part 124 of the shutter 123 and the position of the opening part 122 of the outer cartridge 121 match, the opening part 122 opens (see FIG. 4B). As a result, the toner free-falls by its weight and is supplied to the development part 110 through the opening parts 124 and 122. In addition, simultaneously with the rotation of the lever 125 in the direction of arrow A, the toner cartridge 120 is configured to engage with, and to be fixed with, the development part 110 by an engagement mechanism (not shown).

The toner cartridge 120 includes soft material parts 126*a* and 126*b* having elasticity at a holding position for holding (gripping) the toner cartridge 120. The holding positions are located on the front surface (first surface) and the rear side (second side) of the toner cartridge 120. The number of the soft material parts is not limited to one on each of the front and rear side. The soft material parts may be provided intermittently along the longitudinal direction of the toner cartridge 120. The soft material parts 126*a* and 126*b* are parts to be held by the user at the time of removal for replacing the toner cartridge 120, for example. Here, the soft material parts 126*a* and 126*b* are fitted in, and fixed by an adhesive or the like to, indented parts 127*a* and 127*b*, respectively, formed on front and rear surfaces of the outer cartridge 121 of the toner cartridge 120. The above holding position may be defined as a portion of toner cartridge where the operator's fingers contact the toner cartridge when the operator holds the toner cartridge.

The soft material parts 126*a* and 126*b* are formed with a deformable material, and have a level of deformability to deform by a predetermined amount or more in the holding direction when the user holds the toner cartridge 120. A material for the soft material parts 126*a* and 126*b* is preferably a porous elastic member (spongy material) and more preferably a urethane spongy material. Alternatively, foamed polyethylene may be used. In addition, it is preferred that the deformable material used for the cartridge has elasticity as well. That is because, when the external force is repeatedly applied to the cartridge, the cartridge is expected to recover from the deformation cased by the external force each time after the external force is relieved. Otherwise, the cartridge remains deformed so that the user cannot handle or grip the cartridge comfortably. Further, the deformed cartridge cannot function to absorb the external force or pressure.

Figure 5C:
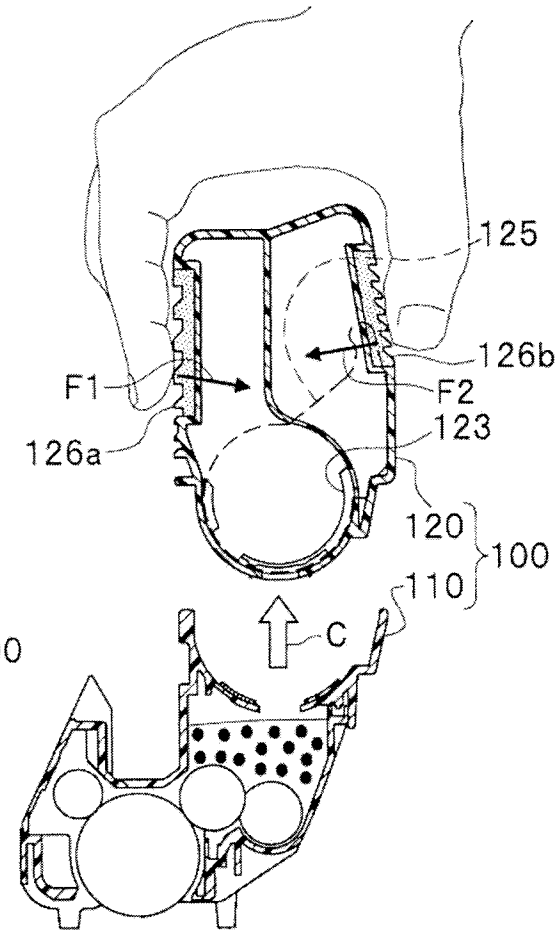
FIGS. 5A-5C are schematic diagrams illustrate conditions for removing the toner cartridge from the image forming unit.
Figure 5B:
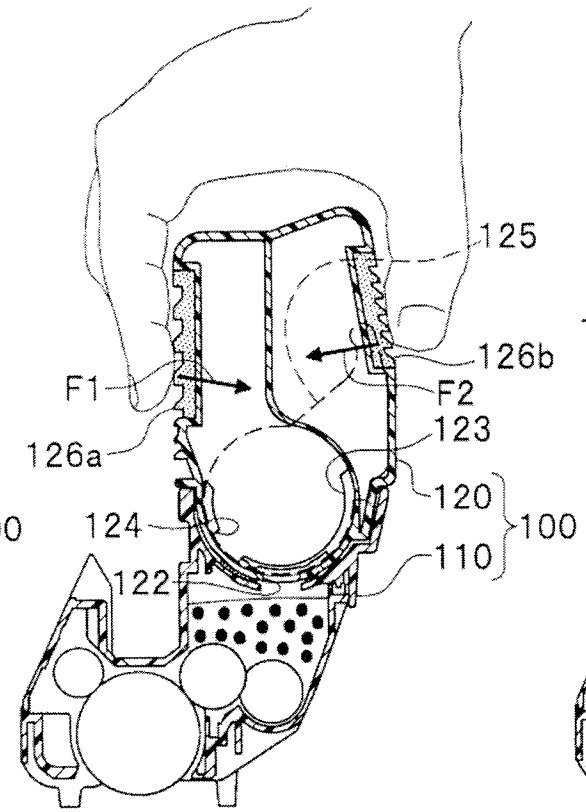
Figure 5A:
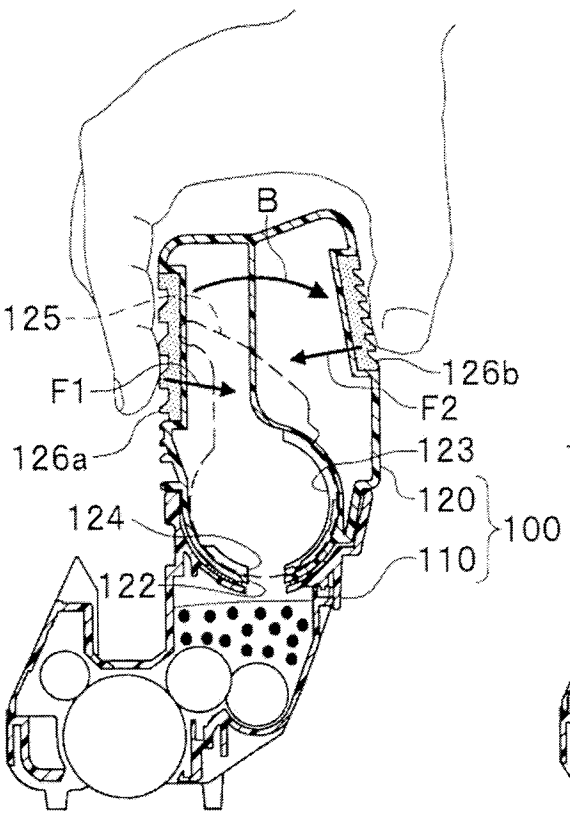

Next, a replacement operation for the toner cartridge according to the first embodiment as configured above is explained. FIGS. 5A-5C are schematic diagrams illustrate conditions for removing the toner cartridge from the image forming unit. FIG. 5A illustrates a state where the toner cartridge is held. FIG. 5B illustrates a state where a lever is rotated to close the opening part. FIG. 5C illustrates a state where the toner cartridge is held and removed by pulling the toner cartridge upwardly.

The image forming device 10 (see FIG. 1) is capable of repeating to print on the media P. However, as the printing is repeated, the toner stored in the toner cartridge 120 is reduced. Then, when a sensor (not shown) detects that the toner inside the toner cartridge 120 is below a predetermined amount, the image forming device 10 (see FIG. 1) displays a notice on a display part (not shown) for the user and requests replacement of the toner cartridge 120. When the user receives the information for replacement, the user performs the replacement operation for the toner cartridge 120.

As shown in FIG. 5A, at the time of replacing the toner cartridge 120, the user first holds the soft material parts 126*a* and 126*b* to remove the toner cartridge 120 from the image forming unit 100. Here, because the soft material parts 126*a* and 126*b* has a level of elasticity to deform by a predetermined amount or more in the holding directions, the user can securely hold the toner cartridge 120 as the fingers break into the inward directions of the soft material parts 126*a* and 126*b*.

Next, as shown in FIG. 5B, the user rotates the lever 125 in the direction of arrow B (see FIG. 5A). While the engagement with the development part 110 of the toner cartridge 120 is released, the opening part 124 of the shutter 123 moves, and a part of the shutter 123 that does not form the opening part 124 closes the opening part 122 of the outer cartridge.

Lastly, as shown in FIG. 5C, by moving the toner cartridge 120 in the direction of arrow C, the toner cartridge 120 is removed from the development part 110 and is replaced with another toner cartridge 120. To place the toner cartridge 120 to the image forming unit 100, the user performs the operation in the reverse order.

Forces F1 and F2 are generated from the user's fingers inwardly to the toner cartridge 120 between the states shown in FIGS. 5A-5C. However, these forces F1 and F2 are absorbed by the soft material parts 126*a* and 126*b* that have elasticity. As a result, rapid and significant change is not generated in the internal pressure of the toner cartridge 120. Therefore, no effects are caused to the toner contained in the toner cartridge 120.

In the present embodiment, a urethane spongy material is used as the material for the soft material parts 126*a* and 126*b*. However, similar effects are obtained using foamed polystyrene. When foamed polypropylene or foamed polystyrene is used that has a lower absorbability of the forces F1 and F2 than the above-described material, the effects are smaller than the case with the above-described material because a pressure is applied inside the toner cartridge 120 due to a counteraction of a restorative force.

As described above, in the image forming device 10 according to the first embodiment, the toner cartridge 120 for accommodating the toner to be supplied to the development part 110 is removably provided to the image forming unit 100, and the toner cartridge 120 includes the soft material parts 126*a* and 126*b* having elasticity at a holding position for holding the toner cartridge 120.

According to the first embodiment, when the user holds the toner cartridge 120, the soft material parts 126*a* and 126*b* deform in the holding directions, thereby providing improvement in the ease to hold the toner cartridge 120 and secure holding of the toner cartridge 120. In addition, the forces F1 and F2 generated at the time of holding the toner cartridge 120 is weakened by absorbing the forces F1 and F2 by the soft material parts 126*a* and 126*b*.

As a result, it is not necessary to significantly deform the outer cartridge 121 of the toner cartridge 120 or to apply a large pressure inside the outer cartridge 121. Therefore, the toner is prevented from being scattered and leaked at the time of holding the toner cartridge 120.

The position of the soft material part is not limited to the front and read surfaces. It may be on the upper surface. It is possible to dispose the soft material part on an arbitrary portion to which an external force may be applied according to its embodiment. The number of the soft material parts is not necessary single. A multiple of the soft material parts may separately be arranged in the longitudinal direction or lateral direction of the toner cartridge. The thickness Ts (See FIG. 3) of the soft material part is also an arbitrary matter. It can be determined considering the deformable feature of the material. For example, in case of using a spongy material made of urethane, an average thickness of a portion (or holding position) to which an external force is to be applied is preferably in a range of 2 to 5 mm. With respect to the embodiment, it is not necessary to dispose the soft material parts on all of the holding positions when there is a plurality of the holding positions. But at least one soft material part should be disposed. When there are two holding positions, it is preferable to dispose the soft material part on each of the two holding positions.

Second Embodiment

Next, a second embodiment of the present application is explained. Configuration shown in the first embodiment and the explanation thereof are referenced for parts that are common with the first embodiment. Different parts from the first embodiment are mainly explained.

Figure 6:
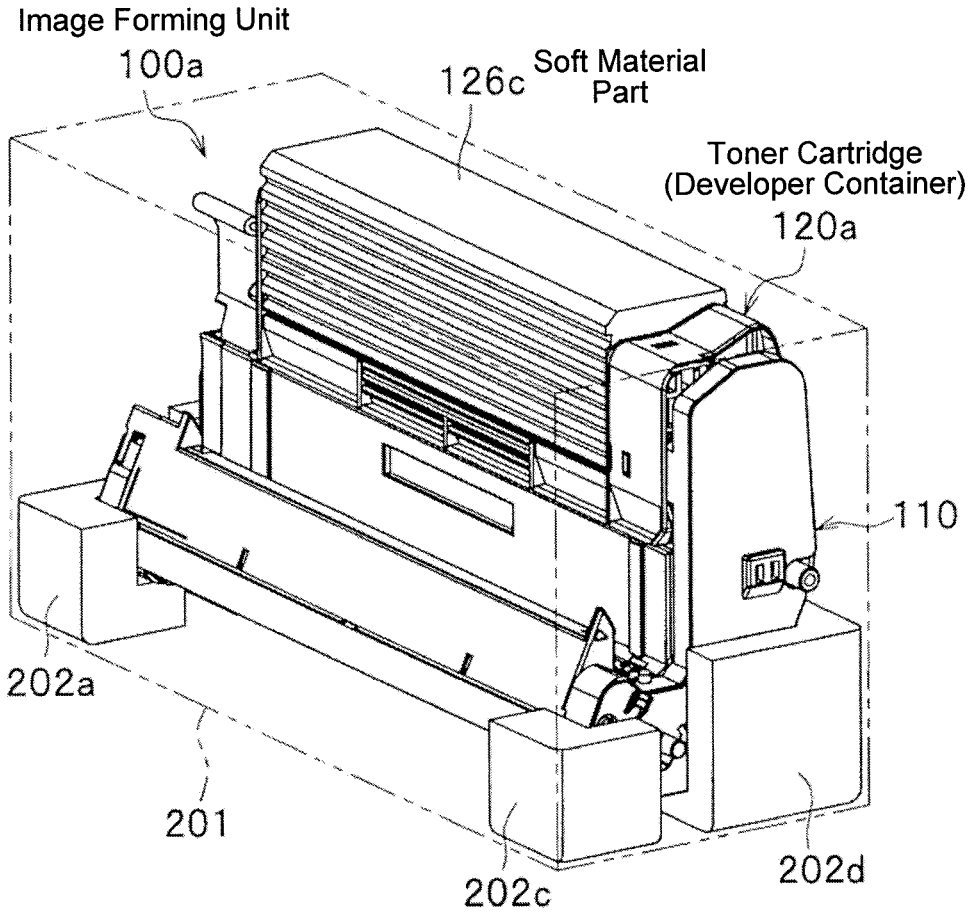
FIG. 6 is an external perspective view illustrating a state where the image forming unit according to a second embodiment is packaged.
Figure 7:
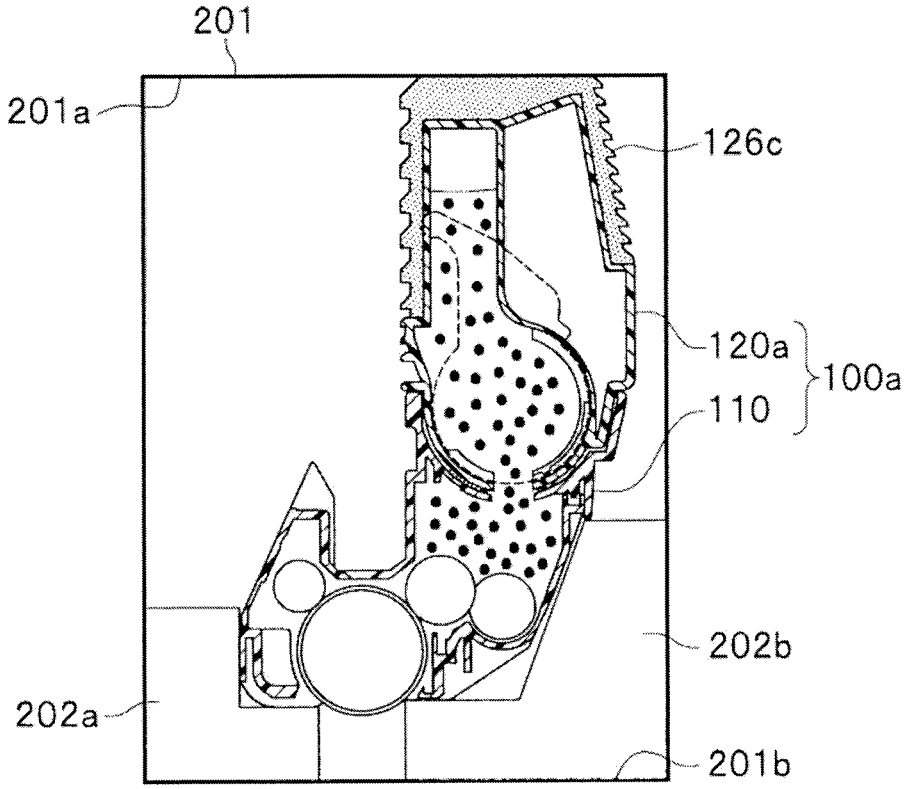
FIG. 7 is a schematic cross-sectional diagram illustrating a package state of the image forming unit according to the second embodiment.

As shown in FIGS. 6 and 7, a package box 201 packages and stores the image forming unit 100*a* at the time of transportation. Cushion materials 202*a* to 202*d* are positioned between the bottom surface of the image forming unit 100*a* and a bottom wall inner surface 201*b* of the package box 201 and absorb vibrations and shocks during the transportation. In other words, the cushion material is used to fill a space between the package box and the image forming unit so that the image forming unit is secured in the box.

The toner cartridge 120*a* according to the second embodiment includes an soft material part 126*c* having deformability provided at a holding position for holding the toner cartridge 120*a*. Similar to the first embodiment, the soft material part 126*c* is formed by a spongy material, such as urethane.

The soft material part 126*c* extends to cover the front and rear surfaces (holding position) and the top surface of the outer cartridge of the toner cartridge 120*a* and is preferably formed integrally. The soft material part 126*c* contacts an upper wall inner surface 201*a* of the package box 201 and becomes a part of the cushion material for protecting the image forming unit 100*a*. That is, the soft material part 126*c* not only allows the user to hold at the time of installing and removing the toner cartridge 120*a*, but also functions as an upper side cushion material for protecting the upper side of the image forming unit 100*a* by contacting the upper wall inner surface 201*a* of the package box 201. In this embodiment, the surface of the soft material part 126*c*, which is a part of the pressure absorbing mechanism, is flat so that the surface fits against an inner surface of the package box 201. There is no cushion material around the soft material part 126*c*. In order to perform this invention, the surface of the pressure absorbing mechanism is not necessary to be strictly flat. As long as soft material part 126 can contact an inner surface of the package box and functions to absorb an external pressure, the surface may be formed as substantially flat. When features of material are considered, the surface of the soft material part 126*c* might be in a wave shape.

According to the second embodiment, there is the following advantage in addition to the advantages similar to the first embodiment. That is, leakage of the toner from a gap between the toner cartridge 120*a* and the development part 110 due to an increase in the internal pressure of the toner cartridge 120*a* is prevented not only at the time of the user's use (replacement of the toner cartridge 120*a*) but even when the shocks and vibrations occur at the time of transporting the brand new image forming unit 100*a* in an unused state, for example. This is because the shocks and vibrations are absorbed by the soft material part 126*c* provided on the toner cartridge 120*a*.

Third Embodiment

Next, a third embodiment of the present application is explained. Configuration shown in the first embodiment and the explanation thereof are referenced for parts that are common with the first embodiment. Different parts from the first embodiment are mainly explained.

Figure 8A:
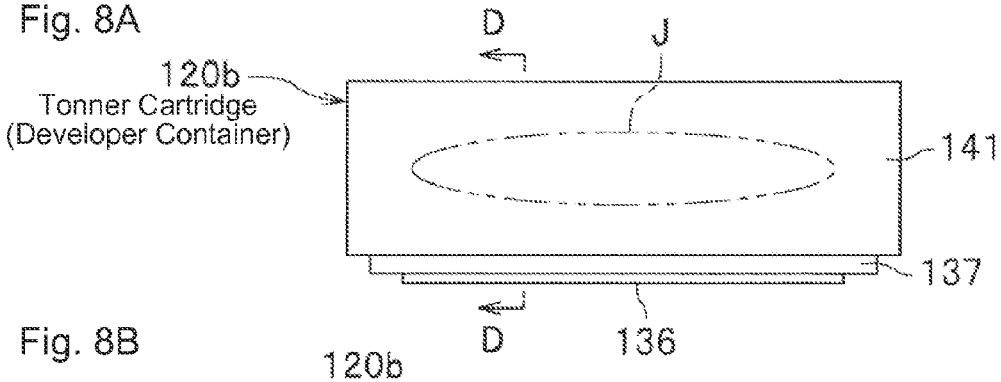
FIGS. 8A and 8B are diagrams schematically illustrating the toner cartridge according to a third embodiment.
Figure 8B:
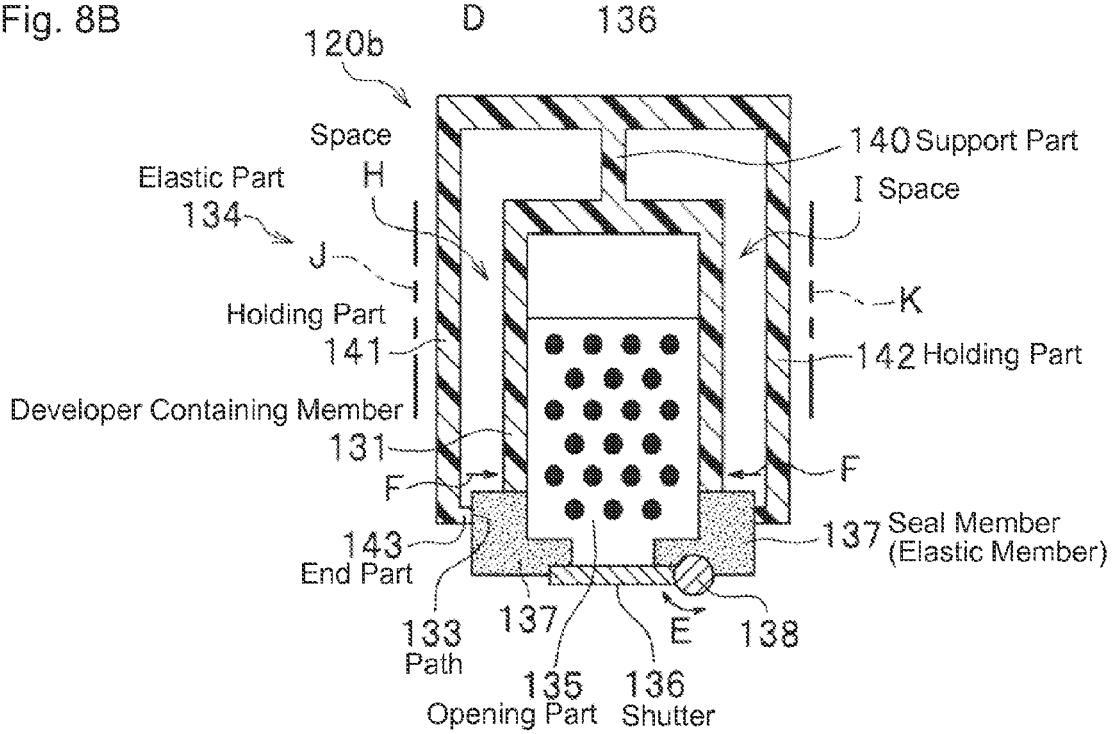

As shown in FIGS. 8A and 8B, a toner cartridge 120*b* according to the third embodiment includes a developer containing member 131 that holds the toner inside. In addition, the toner cartridge 120*b* includes holding parts 141 and 142 positioned outside the developer containing member 131, closed spaces H and I formed between the developer containing member 131 and the holding parts 141, 142, and a vent path 133 for ventilating the air in the closed spaces H and I outside the holding parts 141, 142. The holding parts 141, 142, the closed spaces H and I and the vent path 133 configure a dual wall part 134 having deformability that is provided at the holding position at the time of holding the toner cartridge 120*b*.

The holding parts 141, 142 are connected to the developer containing member 131 with a support part 140. The vent path 133 is formed on the inner side of an end part 143 positioned on the holding parts 141 and 142 opposite from the support part 140. The developer containing member 131 and the holding parts 141, 142 may be formed integrally or may be formed separately but fixedly attached to each other.

The developer containing member 131 includes an opening part 135 for supplying the toner to the development part 110 (see FIG. 3), a shutter 136 for opening and closing the opening part 135, and a seal member 137 provided between the opening part 135 and the shutter 136 for preventing the toner from leaking.

The shutter 136 is openable and closable in the direction of arrow E in FIG. 8B by pivoting about a shaft part 138. The shutter 136 opens when the toner cartridge 120*b* is installed in the image forming unit 100 (see FIG. 3) so that the toner in the toner cartridge 120*b* is supplied to the development part 110 (see FIG. 3).

The seal member 137 is a porous, deformable and elastic member and is formed by a urethane spongy material or the like, for example. Here, a part of the sealing member 137 is provided in the vent path 133. However, a porous elastic member different from the sealing member 137 may be provided in the vent path 133.

The holding parts 141 and 142 are supported by the support part 140, and the seal member 137 is formed from a porous elastic member, such as a spongy material or the like. Therefore, the holding parts 141 and 142 are configured to elastically deform in the direction of arrow F in FIG. 8B when the holding parts 141 and 142 are held by the user in holding regions J and K.

Figure 9:
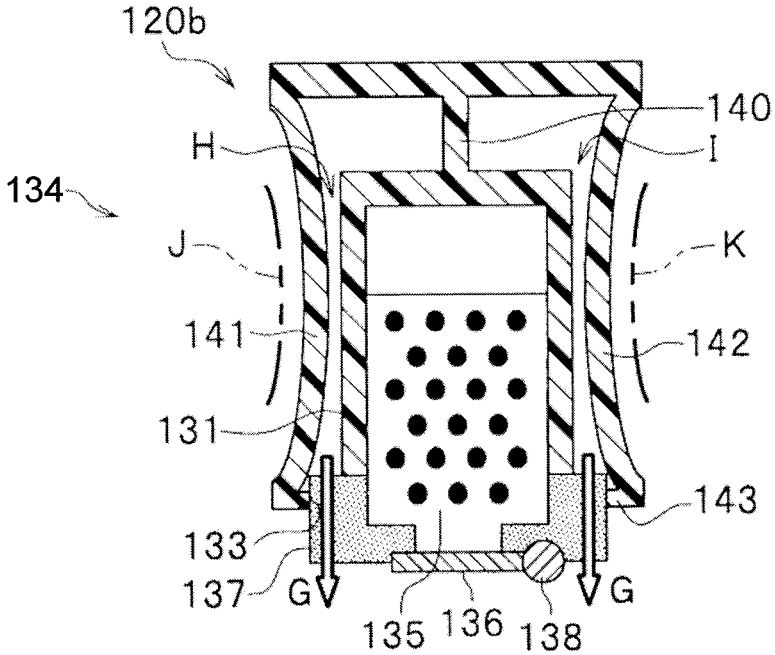
FIG. 9 is a schematic cross-sectional view illustrating a state where the toner cartridge according to the third embodiment is held.

Next, a replacement operation for the toner cartridge 120*b* according to the third embodiment as configured above is explained. FIG. 9 is a schematic cross-sectional view illustrating a state where the toner cartridge according to the third embodiment is held.

The user holds the holding regions J and K of the holding parts 141 and 142 in order to remove the toner cartridge 120*b* from the image forming unit 100 (see FIG. 3). At this time, the holding parts 141 and 142 concavely warp and elastically deform as show in FIG. 9, and inwardly elastically deform (in the direction of arrow F in FIG. 8B) due to an act of the seal member 137. Therefore, the user can securely hold the toner cartridge 120*b*, and a force generated from the holding parts 141, 142 being deformed is suppressed from transmitted to the developer containing member 131.

In addition, because the closed spaces H and I (see FIG. 8B) are squeezed as shown in FIG. 9 when the user holds the holding regions J and K of the holding parts 141 and 142, a pressure of air filled in the closed spaces H and I before the holing increases. However, because the closed spaces H and I are in contact with the spongy seal member 137, the high pressure air passes through the seal member 137 provided in the vent path 133 and ventilated outside the holding parts 141, 142 in the direction of arrow G in FIG. 9. As a result, rapid and significant change is not generated in the internal pressure of the developer containing member 131. Therefore, no effects are caused to the toner held in the developer containing member 131.

As described above, according to the toner cartridge 120*b* according to the third embodiment includes the developer containing member 131 that contains the toner and the dual wall part 134 having elasticity that is provided at the holding position at the time of holding the toner cartridge 120*b*. The dual wall part 134 includes the holding parts 141, 142 positioned outside the developer containing member 131, the closed spaces H and I formed between the developer containing member 131 and the holding parts 141, 142, and the vent path 133 for ventilating the air inside the closed spaces H and I outside the holding parts 141, 142.

According to the third embodiment, only the holding parts 141, 142 that are outer walls of the dual wall part 134 deforms in the holding direction when the user holds the toner cartridge 120*b*, thereby increasing the ease to hold the toner cartridge 120*b* and allowing the holding to be secured. In addition, air pressure generated at the time of holding the toner cartridge 120*b* is relieved by allowing the air to be escaped from the vent path 133. The number of the vent path is not limited to one. A plurality of vent paths may be disposed.

As a result, it is not necessary to significantly deform the developer containing member 131 of the toner cartridge 120*b* or cause the pressure inside the developer containing member 131 to be increased.

Therefore, the toner is prevented from being scattered and leaked at the time of holding the toner cartridge 120*b*.

Forth Embodiment

Next, a fourth embodiment of the present application is explained. Configuration shown in the third embodiment and the explanation thereof are referenced for parts that are common with the third embodiment. Different parts from the third embodiment are mainly explained.

Figure 10A:
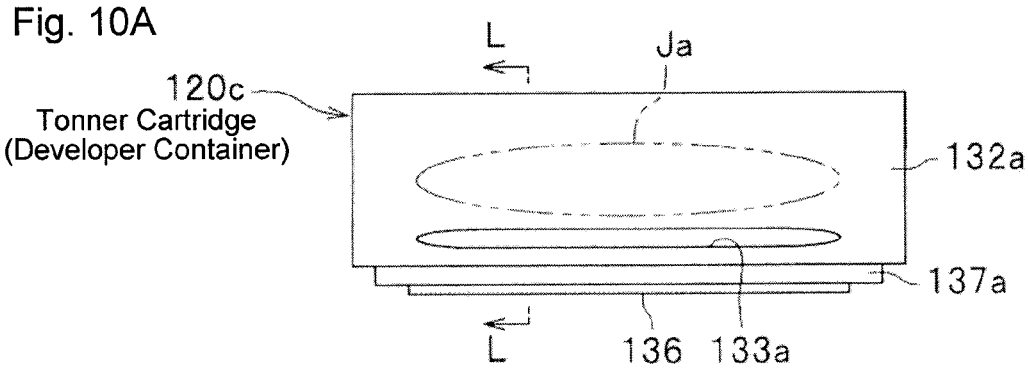
FIGS. 10A and 10B are diagrams schematically illustrating the toner cartridge according to a fourth embodiment.
Figure 10B:
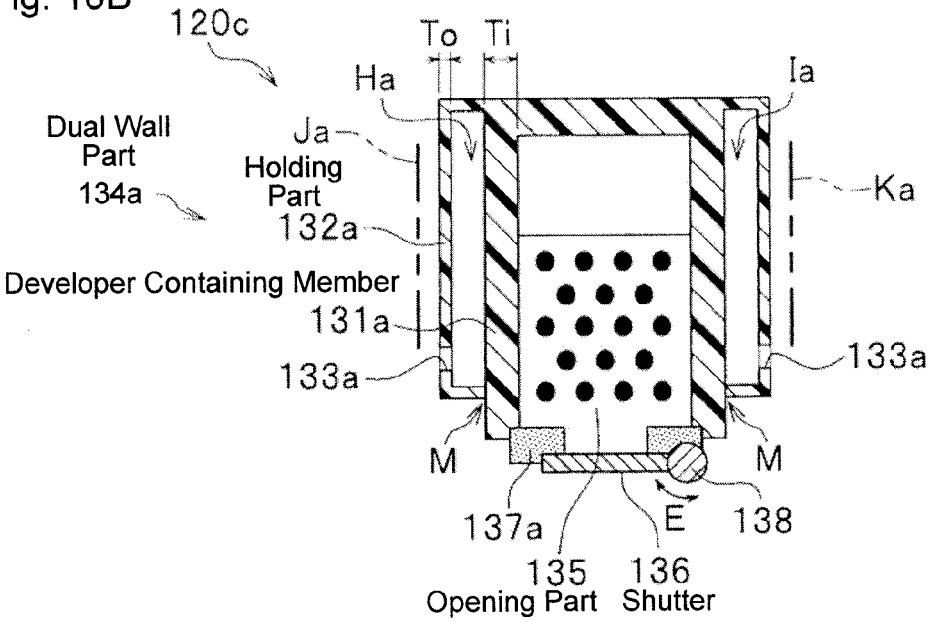

As shown in FIGS. 10A and 10B, a toner cartridge 120*c* according to the fourth embodiment includes a developer containing member 131*a* that holds the toner inside. In addition, the toner cartridge 120*c* includes holding parts 132*a* positioned outside the developer containing member 131*a*, closed spaces Ha and Ia formed between the developer containing member 131*a* and the holding parts 132*a*, and through holes (vent paths) 133*a* that open on the side surfaces (front side and rear side) of the holding parts 132*a* and that allow communication between the closed spaces Ha and Ia and the outside of the holding parts 132*a*. The holding parts 132*a*, the closed spaces Ha and Ia and the through holes 133*a* configure a dual wall part 134*a* having deformability that is provided at the holding position at the time of holding the toner cartridge 120*c*.

In the fourth embodiment, the through holes 133*a* formed on the holding parts 132*a* function as vent paths for ventilating the air in the closed spaces Ha and Ia outside the holding part 132*a*. The developer containing member 131*a* and the holding part 132*a* may be formed integrally or may be formed separately but fixedly attached to each other.

The developer containing member 131*a* includes an opening part 135 for supplying the toner to the development part 110 (see FIG. 3), a shutter 136 for opening and closing the opening part 135, and a seal member 137*a* provided between the opening part 135 and the shutter 136 for preventing the toner from leaking. The seal member 137*a* is a porous elastic member and is formed by a urethane spongy material or the like, for example.

Here, a relationship between a thickness Ti of the developer containing member 131*a* and a thickness To of the holding part 132*a* is configured to Ti>To. With this configuration, the deformation of the holding part 132*a* at the time of holding the holding part 132*a* is hardly transmitted to the developer containing member 131*a*. In addition, the holding part 132*a* and the developer containing member 131*a* are only in contact with each other at a contact region M and are not fixed by an adhesive or the like.

Figure 11:
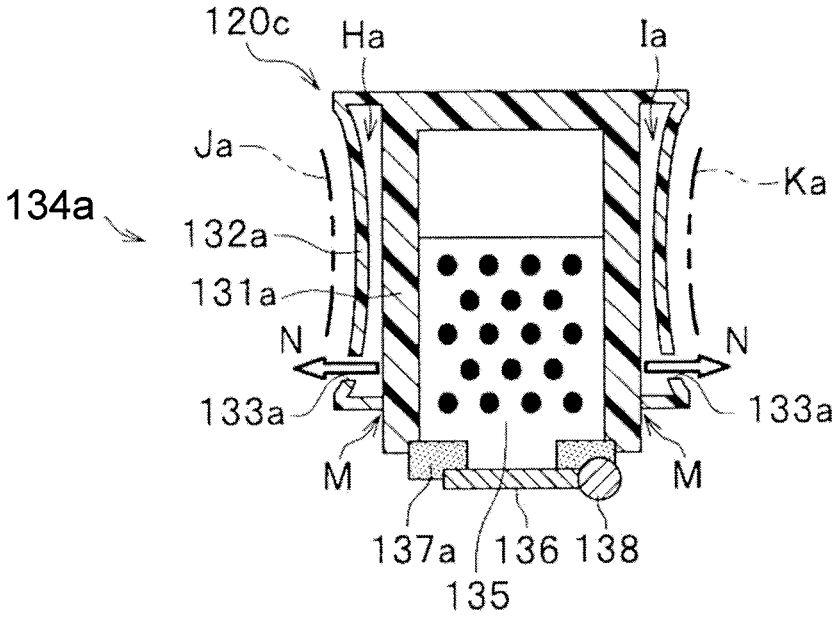
FIG. 11 is a schematic cross-sectional view illustrating a state where the toner cartridge according to the fourth embodiment is held.

Next, a replacement operation for the toner cartridge 120*c* according to the fourth embodiment as configured above is explained. FIG. 11 is a schematic cross-sectional view illustrating a state where the toner cartridge according to the fourth embodiment is held.

The user holds the holding regions Ja and Ka of the holding parts 132*a* in order to remove the toner cartridge 120*c* from the image forming unit 100 (see FIG. 3). At this time, the holding parts 132*a* and the developer containing member 131*a* are only in contact with each other at the contact region M, and the relationship between the thickness Ti of the developer containing member 131*a* and the thickness To of the holding part 132*a* is Ti>To. As a result, the holding parts 132*a* concavely warp and elastically deform as shown in FIG. 11. Therefore, the user can securely hold the toner cartridge 120*c*, and a force generated from the holding parts 132*a* being deformed is suppressed from transmitted to the developer containing member 131*a*.

In addition, because the closed spaces Ha and Ia (see FIG. 10B) are squeezed as shown in FIG. 11 when the user holds the holding regions Ja and Ka of the holding parts 132*a*, a pressure of air filled in the closed spaces Ha and Ia before the holing increases. However, the high pressure air passes through the through holes 133*a* and is ventilated outside the holding parts 132*a* in the direction of arrow N in FIG. 11. As a result, rapid and significant change is not generated in the internal pressure of the developer containing member 131*a*. Therefore, no effects are caused to the toner held in the developer containing member 131*a*.

According to the fourth embodiment, there is the following advantage in addition to the advantages similar to the third embodiment. That is, because there is no need to provide a structure as discussed in the third embodiment in which the end parts 143 of the holding parts 132 are in contact with the seal member 137, the size of the seal member 137*a* and the holding parts 132*a* may be reduced.

The pressure absorbing mechanism of the present invention is described based on the first to fourth embodiments above. However, the present invention is not limited to the configuration described in the above-described embodiments and may be appropriately modified, without departing the object thereof, by appropriately combining or selecting the configurations described in the above-described embodiments.

For instance, the above-described embodiments are explained with a printer as an example. However, the present application is not limited to the printer but may be implemented in image forming devices, such as copy machines, facsimile devices, multifunction peripherals including a printer part and a scanner part, and the like.

Moreover, the above-described embodiments are explained with a tandem-type image forming device as an example. However, the present application is not limited to the tandem-type image forming device but may be implemented in an intermediate transfer-type image forming device that once transfers a toner image formed on a photosensitive body onto an intermediate transfer belt and then transfers the toner images in various colors formed on the intermediate transfer belt together onto a medium, for example.

Further, the above-described embodiments are explained with an image forming device that forms color images as an example. However, the present application is not limited to such image forming device but may be implemented in an image forming device that forms monochrome images, for example.

Furthermore, the above-described embodiments are explained with an LED-type image forming device that provides an electrostatic latent image on the photosensitive drum using LEDs. However, the present application is not limited to such image forming device but may be implemented in a laser-type image forming device that provides the electrostatic latent image on the photosensitive drum using laser, for example.

In addition, in the fourth embodiment, the through holes 133*a* are open on the side surfaces (front surface and rear surface) of the holding part 132*a*. However, the through holes 133*a* may be open on the bottom surface or the top surface of the holding part 132*a*.

What is claimed is:

1. A developer container, comprising:

a developer containing member that contains developer and that includes a side wall;

an opening part through which the developer is externally supplied; and a pressure absorbing mechanism that is formed by an elastic member, which is a separate body from the developer containing member, and that is attached to an external surface of the side wall of the developer containing member, wherein the pressure absorbing mechanism is configured to deform in an inward direction toward the developer containing member when an external force is applied to the developer containing member.

2. The developer container of claim 1, wherein the developer container is configured to be detachable with respect to an image forming unit that includes a photosensitive body and that develops an electrostatic latent image formed on the photosensitive body using the developer.

3. The developer container of claim 1, wherein the pressure absorbing mechanism is configured to cover holding positions of the developer container, the holding positions being defined as portions where an operator's fingers contact the developer containing member when the operator holds the developer container.

4. The developer container of claim 3, wherein the holding positions are located on front and rear surfaces of the developer container.

5. The developer container of claim 3, wherein the pressure absorbing mechanism is configured with a deformable material in order to absorb the external force.

6. The developer container of claim 5, wherein the deformable material of the pressure absorbing mechanism further has elasticity.

7. The developer container of claim 1, wherein the pressure absorbing mechanism is configured to cover holding positions located on front, rear and upper surfaces of the developer container.

8. The developer container of claim 7, wherein the holding positions are further defined as portions where an operator's fingers contact the developer containing member when the operator holds the developer container;

the pressure absorbing mechanism is configured with a deformable material in order to absorb the external force, and the pressure absorbing mechanism is integrally formed.

9. A packaging system, comprising a package box, and the developer container of claim 8, wherein an upper surface of the pressure absorbing mechanism which covers the upper surface of the developer container is substantially flat, when the developer container is housed in the package box, the upper surface of the pressure absorbing mechanism fits against an inner surface of the package box so that there is not space between the box and the developer container along the flat upper surface of the pressure absorbing mechanism.

10. The packaging system of claim 9, further comprising an image forming unit that includes a photosensitive body and that develops an electrostatic latent image formed on the photosensitive body using the developer, to which the developer container is detached, a cushion material that absorbs vibrations and shocks, wherein the cushion material is arranged on an opposite side from the upper surface of the developer container so that a space between the image forming unit and the package box is filled with the cushion material, and no cushion material is arranged around the upper surface of the developer container.

11. The developer container of claim 1, wherein the side wall includes an indented portion thereon, and the pressure absorbing mechanism is attached within the indented portion.

12. The developer container of claim 11, wherein the pressure absorbing mechanism is formed by a porous elastic member.

13. A developer container, comprising:

a developer containing member that contains developer;

an opening part through which the developer is externally supplied; and a pressure absorbing mechanism that is provided on an external portion of the developer containing member, wherein the pressure absorbing mechanism is configured to deform in an inward direction toward the developer container when an external force is applied to the developer container, and the pressure absorbing mechanism is configured to cover an upper surface of the developer container in order to absorb the external force that is applied from the top.

14. The developer container of claim 13, wherein the developer container is configured to be detachable with respect to an image forming unit that includes a photosensitive body and that develops an electrostatic latent image formed on the photosensitive body using the developer.

15. The developer container of claim 13, wherein the pressure absorbing mechanism is configured to cover holding positions of the developer container, the holding positions being defined as portions where an operator's fingers contact the developer containing member when the operator holds the developer container.

16. The developer container of claim 15, wherein the holding positions are located on front and rear surfaces of the developer container.

17. The developer container of claim 15, wherein the pressure absorbing mechanism is configured with a deformable material in order to absorb the external force.

18. The developer container of claim 17, wherein the deformable material of the pressure absorbing mechanism further has elasticity.

19. A developer container, comprising:

a developer containing member that contains developer;

an opening part through which the developer is externally supplied; and a pressure absorbing mechanism that is provided on an external portion of the developer containing member, wherein the pressure absorbing mechanism is configured to deform in an inward direction toward the developer container when an external force is applied to the developer container, the pressure absorbing mechanism is configured with a holding part that is disposed surrounding the developer containing member and that defines a closed space between the developer containing member and the holding part, and a vent path that connects the closed space, and an air in the closed space is vented only through the vent path.

20. The developer container of claim 19, wherein the vent path is defined in the holding part.

21. The developer container of claim 19, wherein a thickness (Ti) of the developer containing member is thicker than a thickness (To) of the holding part.

22. The developer container of claim 19, wherein the pressure absorbing mechanism further comprises a support part with which the holding part is connected to the developer containing member, the vent path is positioned at an opposite side from the support part with respect to the developer containing member, the vent path is filled with a deformable porous member through which the air in the closed space passes.

23. The developer container of claim 22, wherein the deformable porous member further has elasticity.

24. The developer container of claim 22, wherein the porous member further has elasticity, one end of the holding part is firmly supported with the support part, and the other end of the holding part is flexibly supported with the porous member having the elasticity so that the holding part at the other end moves more than at the one end when the operator holds the developer container.

* * * * *